US007167147B2

(12) United States Patent
Tanaka et al.

(10) Patent No.: US 7,167,147 B2
(45) Date of Patent: Jan. 23, 2007

(54) DISPLAY DEVICE AND METHOD OF DRIVING THE SAME

(75) Inventors: Haruo Tanaka, Kyoto (JP); Takashi Nakamura, Kyoto (JP)

(73) Assignee: Rohm Co. Ltd., Kyoto (JP)

( * ) Notice: Subject to any disclaimer, the term of this patent is extended or adjusted under 35 U.S.C. 154(b) by 663 days.

(21) Appl. No.: 09/757,491

(22) Filed: Jan. 11, 2001

(65) Prior Publication Data

US 2001/0007447 A1 Jul. 12, 2001

(30) Foreign Application Priority Data

Jan. 11, 2000 (JP) ..... 2000-006019

(51) Int. Cl.
*G09G 3/32* (2006.01)

(52) U.S. Cl. ..... 345/82; 345/76

(58) Field of Classification Search ..... 345/87, 345/90, 92, 98, 100, 205, 206, 76, 77, 82–84, 345/204, 78; 315/169.1–169.4; 365/145
See application file for complete search history.

(56) References Cited

U.S. PATENT DOCUMENTS 5,302,966 A * 4/1994 Stewart ..... 345/76
5,349,366 A * 9/1994 Yamazaki et al. ..... 345/92
5,463,279 A * 10/1995 Khormaei ..... 315/169.3
5,587,329 A * 12/1996 Hseuh et al. ..... 438/30
5,631,664 A * 5/1997 Adachi et al. ..... 345/74.1
5,684,365 A * 11/1997 Tang et al. ..... 315/169.3
5,708,454 A * 1/1998 Katoh et al. ..... 345/100
5,952,789 A * 9/1999 Stewart et al. ..... 315/169.4
6,069,381 A * 5/2000 Black et al. ..... 257/316
6,175,345 B1 * 1/2001 Kuribayashi et al. ..... 345/76
6,188,375 B1 * 2/2001 Kagey ..... 345/76
6,225,969 B1 * 5/2001 Ishii ..... 345/100
6,229,506 B1 * 5/2001 Dawson et al. ..... 345/82
6,278,242 B1 * 8/2001 Cok et al. ..... 315/169.1
6,373,455 B1 * 4/2002 Kuribayashi et al. ..... 345/76
6,433,488 B1 * 8/2002 Bu ..... 315/169.3
6,459,208 B2 * 10/2002 Battersby ..... 315/169.3
6,462,722 B1 * 10/2002 Kimura et al. ..... 345/76
6,521,927 B2 * 2/2003 Hidaka et al. ..... 257/295
6,522,315 B2 * 2/2003 Ozawa et al. ..... 345/92
6,563,480 B1 * 5/2003 Nakamura ..... 345/82
2002/0153881 A1 * 10/2002 Taguchi et al.

FOREIGN PATENT DOCUMENTS

JP 05-119298 5/1993
JP 08-241057 9/1996
JP 11-109891 4/1999

* cited by examiner

*Primary Examiner*—Regina Liang
(74) *Attorney, Agent, or Firm*—Arent Fox PLLC

(57) ABSTRACT

For example, a display element (1) formed by an organic EL element and a control element formed by a MOS transistor (2) are connected in series between a driving line (6) to be driven with a voltage or a current and a ground. A gate of the MOS transistor (2) is connected to a control line (7) through a nonvolatile data holding section such as a ferroelectric capacitor (3), and control data of the MOS transistor (2) can be held in a floating state. As a result, the ON/OFF data of each pixel are held in the floating state, and display data are rewritten to only a pixel to be changed in a display state of ON/OFF or the like and held data are displayed on a pixel which is not changed in the display data. Consequently, it is possible to obtain a nonvolatile display device capable of reducing power consumption and operating with a small battery.

8 Claims, 7 Drawing Sheets

DISPLAY DEVICE AND METHOD OF DRIVING THE SAME

FIELD OF THE INVENTION

The present invention relates to a nonvolatile display device capable of exactly maintaining a display state without applying data to a pixel (dot) in the same display state when forming the pixel in a matrix and sequentially displaying an image or a video such as a dynamic image which is obtained by a computer, and a method of driving the display device. More specifically, the present invention relates to a nonvolatile display device having a nonvolatile data holding section provided on a control element for controlling ON/OFF of each pixel, and a method of driving the display device.

BACKGROUND OF THE INVENTION

Conventionally, a cathode ray tube or a liquid crystal has been used in a display of a computer or the like, and a light emitting diode (LED) or a liquid crystal has been used in a large display on the street, in which a light emitting section is formed in a matrix to constitute each pixel and a displayed image is sequentially changed by turning ON/OFF the pixel.

In the display using the liquid crystal, each pixel is constituted by an indicating section 51 and a thin film MOSFET 52 to be a switching element (control element) as shown in an equivalent circuit diagram of FIG. 12, for example. Gates of the MOSFETs 52 which are arranged in a row direction are connected to a scanning line X and sequentially scanned through scanning lines $X_1$, $X_2$, $X_3$ . . . , and drains of the MOSFETs 52 which are arranged in a column direction are connected to one of data lines $Y_1$, $Y_2$, $Y_3$ . . . . Thus, each pixel is driven by their combination. The reference numeral 53 denotes an auxiliary capacitor for holding a voltage to be applied until the next scan for line-sequential scan.

A liquid crystal layer is a kind of capacitor, and holds the applied voltage to some extent but cannot hold the same voltage until the next scan for the line-sequential scan through discharge thereof. Therefore, the auxiliary capacitor 53 is provided in some cases. Even this auxiliary capacitor can hold a voltage only until the next scan, and should always apply data even if data for ON/OFF are the same. Also in the case in which another light emitting element such as an LED is used, this phenomenon is generated in the same manner. Particularly, it is necessary to rewrite approximately 60 times per second in the case in which a dynamic image is to be displayed.

As described above, in the conventional display device, the data for turning ON/OFF each pixel to display an image should be always applied every constant time even if the ON/OFF of the pixel is not changed. In the case in which a dynamic image is to be displayed, particularly, the data should be updated at a rate of approximately 1/60 sec. Even if the data to be updated are almost the same, all the data should be applied to each pixel at each time. So, great power is consumed for rewriting the data. Although it is necessary to drive by a small battery in a very small portable head mounted display such as a microdisplay or the like, the size of the battery should be increased by the consumption of the great power. Therefore, practical use has become a problem.

SUMMARY OF THE INVENTION

In order to solve such a problem, it is an object of the present invention to provide a nonvolatile display device capable of holding data for ON/OFF of each pixel in a floating state, rewriting display data for only a pixel changing the display state of ON/OFF or the like, and displaying by the held data for a pixel which does not change the display data, thereby reducing power consumption and operating with a small battery.

It is another object of the present invention to provide a specific structure when a ferroelectric capacitor is used as a nonvolatile data holding section.

It is still another object of the present invention to provide a method of driving a nonvolatile display device capable of applying new data to only a pixel changing the display state without applying display data to each pixel at any time, thereby reducing power consumption when the display device is to be driven.

The present invention provides a nonvolatile display device comprising; a display element, a control element for controlling a voltage or a current to be applied to the display element to drive the display element, and a nonvolatile data holding section integrated with the control element or connected to the control element and capable of holding control data of the control element in a floating state.

The control element implies an element for controlling the display, for example, a driving transistor capable of feeding a current if the display element is an element to be driven with a current such as an organic EL element or an LED, or a switching element for turning ON/OFF by the application of a voltage if the display element is an element to be driven with a voltage such as a liquid crystal. Moreover, the display element implies one light emitting element or one pixel portion of a liquid crystal panel which can constitute one pixel.

With such a structure, a nonvolatile data holding section is provided. Therefore, in the case in which data in the display state of a certain pixel are the same, it is not necessary to rewrite the data and it is sufficient that data for only a pixel changing data on the display state are rewritten. As a result, the number of pixels to be rewritten is greatly reduced so that power consumption for rewriting is reduced. Thus, the power consumption of the display device itself can be reduced considerably.

The control element is formed of a MOS transistor type element, one of a drain and a source of the element is connected to the display element and the other is connected to a driving line, a gate side of the MOS transistor type element is connected to a control line through the nonvolatile data holding section, and plural sets of the display element, the control element and the nonvolatile data holding section are formed as each pixel in a matrix. Consequently, the display can be constituted in a matrix by utilizing the nonvolatile data holding section of a semiconductor storage device type, and the display of each pixel can be controlled by a combination in row and column directions.

The MOS transistor element implies a MOSFET as well as a modified transistor such as an MFT or MFIT structure having a ferroelectric layer provided in place of a gate oxide film or together with the gate oxide film on the gate side.

A selective transistor is connected between the nonvolatile data holding section and the control line and a gate of the selective transistor is connected to a selective line. Consequently, the nonvolatile data holding sections of individual pixels can hold intermediate data other than 0 and 1 and gradation display can also be carried out.

If the nonvolatile data holding section is formed of a ferroelectric capacitor, a data writing speed is increased and a writing lifetime is long, that is, $10^{12}$ times or more, which is very suitable for making the display device nonvolatile.

The control element and the nonvolatile data holding section are formed of a transistor having an MFS structure or an MFIS structure in which a ferroelectric capacitor is formed integrally on the gate side of the MOS transistor, a back gate of the MOS transistor is connected to a write line and the control data can be written to the nonvolatile data holding section between the control line and the write line, or are formed by a transistor having an MFMIS structure in which a ferroelectric capacitor is connected to the gate side of the MOS transistor through a common electrode or a wiring, a capacitor is connected between a connecting portion of a gate electrode of the MOS transistor and the ferroelectric capacitor and a ground or a write line, and the control data can be written to the nonvolatile data holding section between the control line and the ground or write line.

The nonvolatile data holding section can also be constituted by an element utilizing a magnetoresistance effect or by a single electron memory.

If the display device is constituted by the organic EL element, a small-sized display device can easily be manufactured and gradation display can be carried out, which is suitable for constituting a very small display device such as a microdisplay with low power consumption.

The preset invention provides a method of driving a nonvolatile display device wherein display elements constituting each pixel are arranged in a matrix and ON/OFF of each of the display elements is controlled to sequentially change a display image by a control element provided in the each of the display elements, comprising the steps of; providing a nonvolatile data holding section in the control element for controlling a driving operation of the each of the display elements, carrying out a display on a display element having no change in a control state of the display elements based on the data of the nonvolatile data holding section without applying the display data, and applying and displaying the new display data to only a display element to be changed in a display state, and recording the new display data in the nonvolatile data holding section.

DETAILED DESCRIPTION

Figure 1:
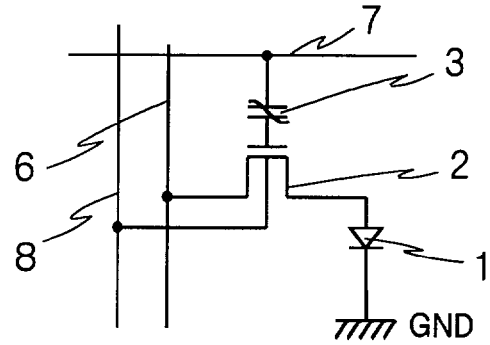
FIG. 1 is a diagram illustrating the basic structure of a display device according to an embodiment of the present invention.

Next, description will be given to a nonvolatile display device and a method of driving the nonvolatile display device according to the present invention with reference to the drawings. In the nonvolatile display device according to the present invention, a display element 1 composed of an organic EL element and a control element composed of a MOS transistor 2 are connected in series between a driving line 6 to be driven with a voltage or a current and a ground GND, for example, as shown in FIG. 1 which is an equivalent circuit diagram illustrating a basic structure thereof. A gate of the MOS transistor 2 is connected to a control line 7 through a nonvolatile data holding section 3 composed of a ferroelectric capacitor 3 and can hold the control data of the MOS transistor 2 in a floating state.

Figure 5:
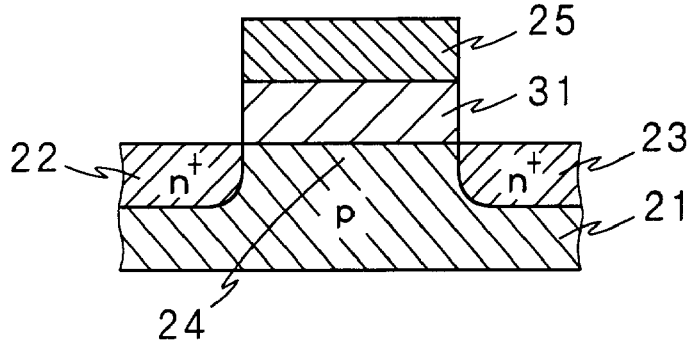
FIGS. 5(*a*) to 5(*d*) are diagrams illustrating the structure of a ferroelectric memory in which a MOS transistor and a ferroelectric capacitor are combined.
Figure 5:
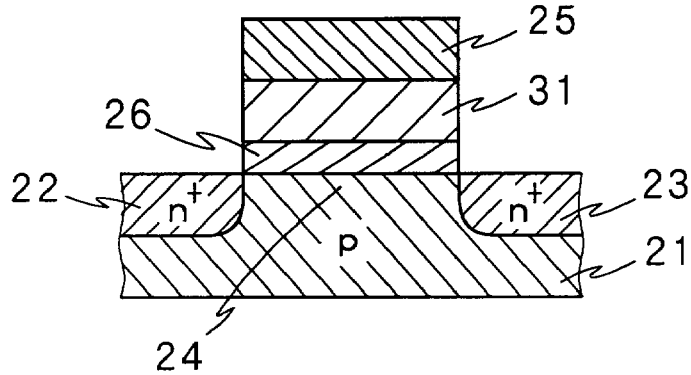
Figure 5:
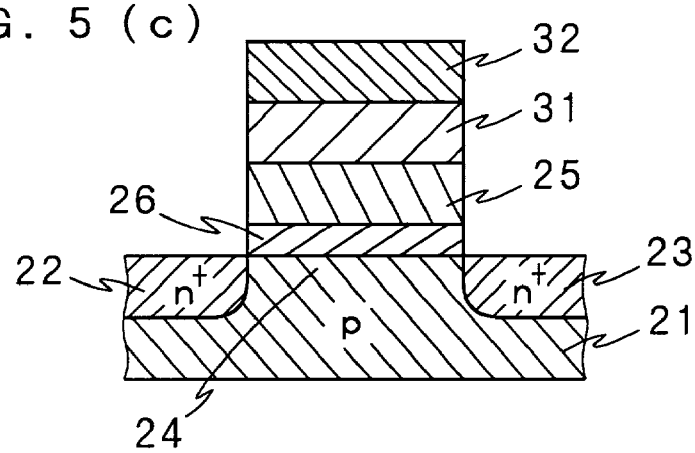
Figure 5:
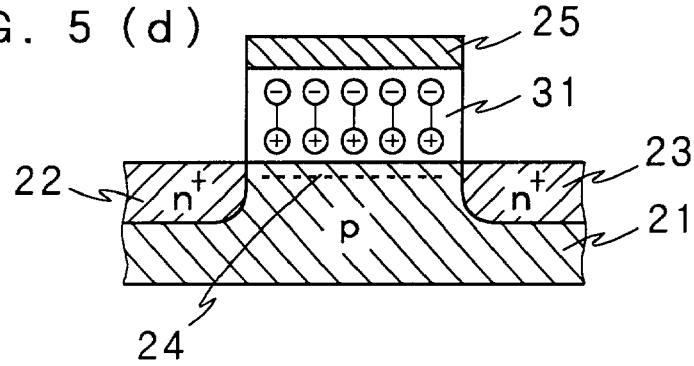

The control element 2 and the nonvolatile data holding section 3 may be formed to have the same structures as those of an EEPROM and a flash memory in a semiconductor memory. An example of an ferroelectric memory using a ferroelectric layer is shown in FIGS. 5(*a*) to 5(*c*). FIG. 5(*a*) shows an example of an MFS structure in which a gate electrode (M) 25 is provided through a ferroelectric layer (F) 31 on a channel region (S) 24 interposed by n-type regions to be a source 22 and a drain 23 which are formed on a p-type semiconductor substrate 21. Moreover, FIG. 5(*b*) shows an example of an MFIS structure in which a buffer layer (I) 26 such as $SiO_2$ is provided between the ferroelectric layer 31 and the semiconductor substrate 21 (channel region 24) in FIG. 5(*a*).

Furthermore, FIG. 5(*c*) shows an example of an MFMIS structure in which an electrode to be the gate electrode (M) 25 is provided between the ferroelectric layer 31 and the buffer layer 26 in FIG. 5(*b*) and an electrode provided on the ferroelectric layer 31 is formed as an upper electrode (M) 32 of the ferroelectric capacitor 3. With the MFMIS structure, the ferroelectric capacitor 3 is not formed on the channel region but may be formed in another part and be electrically connected to the gate electrode 25.

Figure 6:
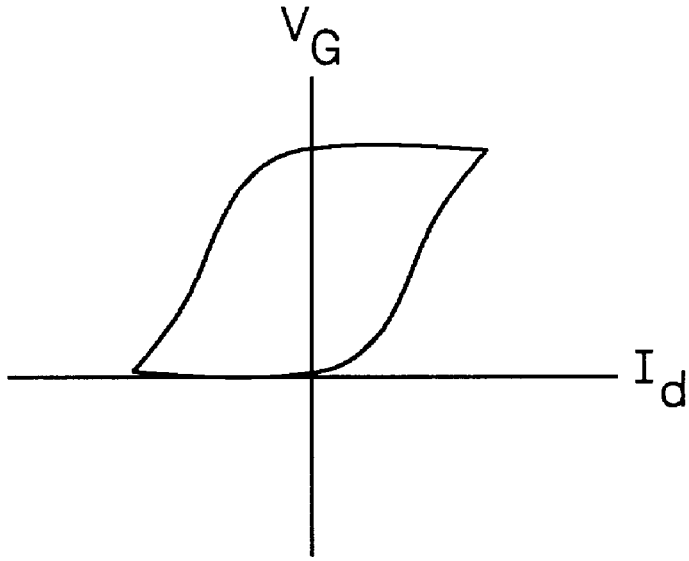
FIG. 6 is a chart showing a hysteresis characteristic of a ferromagnetic substance.

The operation of the MFS structure will be described with reference to FIG. 5(*d*). When a positive voltage is applied to the gate electrode 25, the ferroelectric layer 31 is polarized as shown in FIG. 5(*d*) and electrons are induced into the channel region so that a depletion layer is formed. Consequently, the drain 22 and the source 23 are conducted so that a display section 1 is turned ON. In addition, the ferroelectric layer 31 has a hysteresis characteristic as shown in FIG. 6. Therefore, even if the application of a positive voltage to the gate electrode 25 is removed, the polarization state is maintained as it is and a conductive (ON) state is held. More specifically, the ferroelectric capacitor 3 having the ferroelectric layer 31 interposed between the gate electrode 25 and the semiconductor substrate 21 is formed on the gate of the control element in the MOS transistor. Data are held by the ferroelectric layer 31. This relationship is also operated with the structures shown in FIGS. 5(*b*) and 5(*c*) in the same manner.

The display element 1 can be constituted by a liquid crystal display element, an organic EL element, an LED or the like. In order to constitute a very small microdisplay having a size of the whole display device of approximately several cm per square or less, a driving current should be considerably reduced also in the organic EL element. If the organic EL element has a constant current or more, a light having an intensity corresponding to a current value is emitted. Therefore, by controlling the current value, gradation display can easily be carried out, which is preferable. In the example shown in FIG. 1, the organic EL element is used as the display element.

Figure 7:
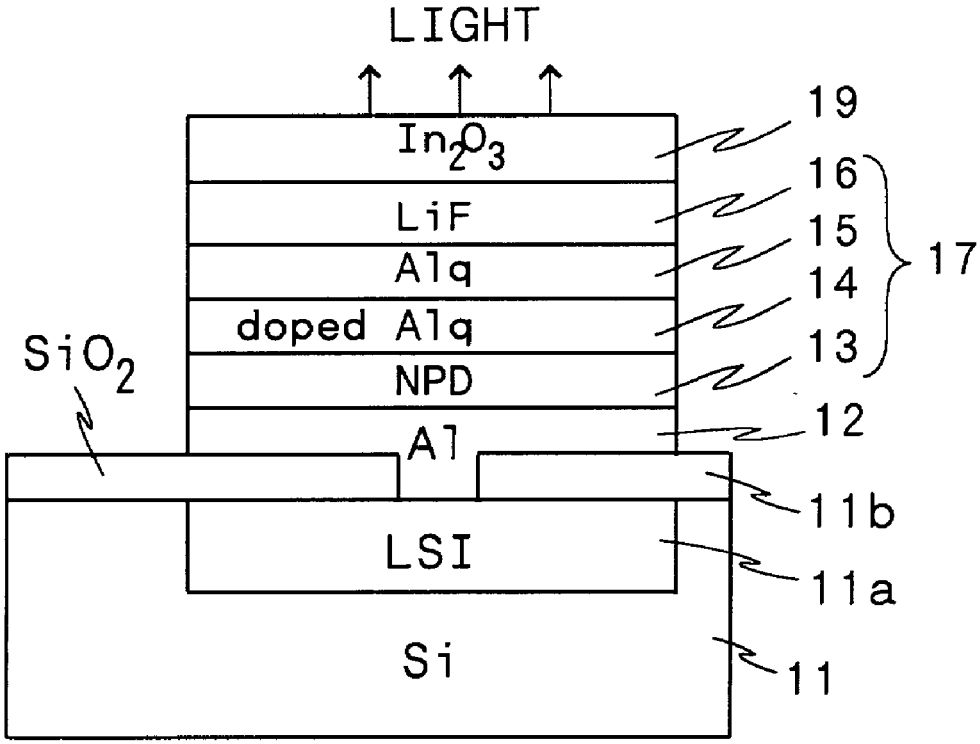
FIG. 7 is a diagram illustrating a structure of an organic EL element.

The organic EL element is provided with a first electrode 12 formed of Al, Cu, Mg, Ag or the like so as to be connected to an output electrode of a control circuit (LSI) 11*a* formed on a substrate (wafer) 11 made of silicon or the like through a contact hole of an insulating film 11*b* such as $SiO_2$ as shown in FIG. 7, for example. An organic layer 17 having at least an EL light emitting layer 14 is provided on the first electrode 12. A second electrode 19 having a light transmitting property such as indium oxide is provided on the organic layer 17. The organic layer 17 includes a hole transporting layer 13 comprising NPD, for example, an EL light emitting layer 14 composed of Alq doped with 1% by weight of quinacridone or coumalin, an electron transporting layer 15 comprising Alq and an electron injecting layer 16 comprising LiF. In the case in which a light emitting output is to be monitored, a transparent electrode such as an ITO is sometimes used as the first electrode 12.

By changing the material of the organic layer 17, a light emitting color can be varied. By providing a color filter, one pixel is formed by primaries of R, G and B. Alternatively, patterning is carried out to obtain a necessary pixel number from simple display of approximately 100×100 or less to precise display of approximately 1000×1000 or less by monochrome so that each pixel is formed in a matrix. Consequently, a very small microdisplay having several cm per square or less is formed with fine color display.

Figure 8:
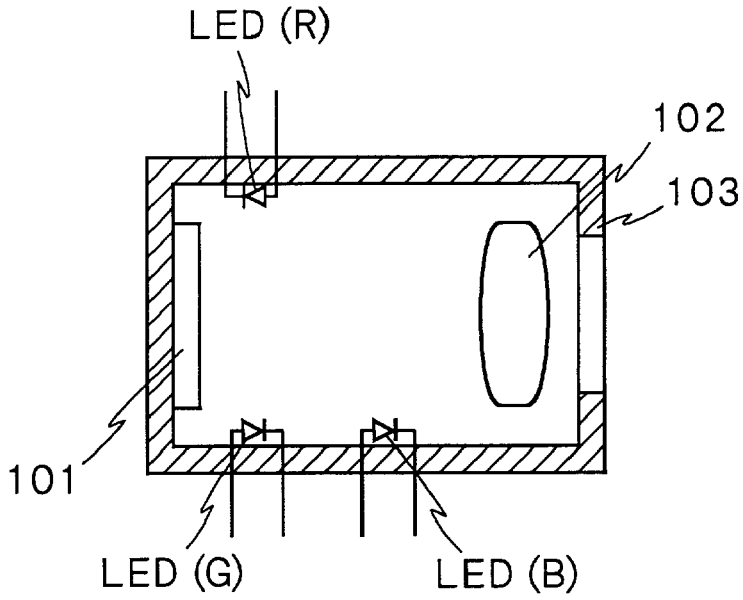
FIG. 8 is a diagram illustrating an example in which a microdisplay is constituted by a reflection type liquid crystal panel.

In the case in which each pixel of a liquid crystal display is to be used as the display element 1, it is preferable that the control element 2 and the nonvolatile data holding section 3 should be formed on a silicon substrate or the like as described above. Therefore, it is preferable that a reflection type liquid crystal display should be formed. In the case in which the reflection type liquid crystal panel is to be formed, LEDs of R, G and B are provided on the front side of the reflection type liquid crystal panel 101 formed on the silicon substrate as shown in FIG. 8 which is a sectional view showing an example of the microdisplay. By controlling the LED synchronously with the driving operation of a liquid crystal, color display can be obtained with fine pixels. The reference numeral 102 denotes a lens for directly forming an image on a retina of human eyes and the reference numeral 103 denotes a case.

Next, the operation of the basic structure shown in FIG. 1 will be described. With this structure, a set of the organic EL element 1 constituting one pixel, the MOS transistor 2 and the nonvolatile data holding section 3 is provided in a matrix, and the organic EL element 1 of each pixel arranged in a column direction and the source and drain of the MOS transistor 2 are connected in series between the driving line 6 and the ground GND, for example. The driving line 6 is not restricted to the column direction but all the pixels can be connected in common. The gate side of the MOS transistor 2 of each pixel arranged in the row direction is connected to a control line 7 through the ferroelectric capacitor (the above-mentioned MFS, MFIS or MFMIS structure) 3, and a back gate of the MOS transistor 2 of the pixel arranged in the column direction is connected to a write line 8. Consequently, a matrix for selecting a pixel by specification of a row line and a column line is formed.

More specifically, a voltage is applied between the control line 7 and the write line 8 so that the ferroelectric layer can be polarized as described above. A signal for controlling the ON/OFF of the organic EL element 1 is applied to the MOS transistor 2 to be a control element and is written to the data holding section 3. In this case, the ON/OFF can be reversed by reversing the positive and negative signs of the voltage to be applied between the control line 7 and the write line 8. By applying a reverse voltage to only the pixel to be ON/OFF changed, each pixel can be always controlled to be set in the display state. If there is no write line as in an example of FIG. 3 which will be described below, a pixel to be selected on a selecting line 9 connecting a pixel in the column direction is specified. The connections in the row and column directions may be reversed, respectively.

Figure 9:
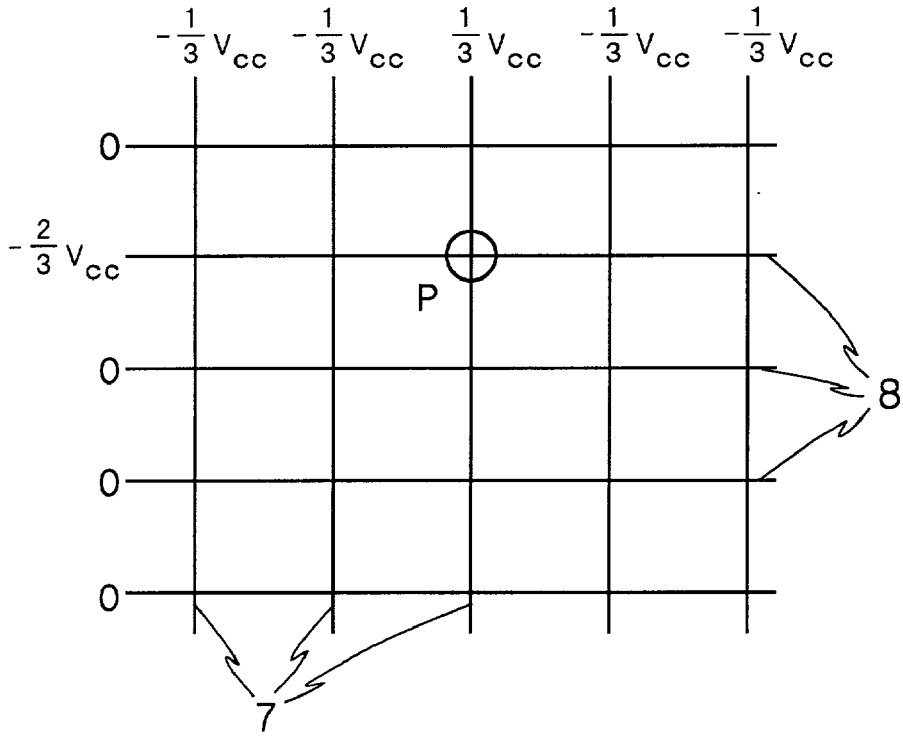
FIG. 9 is a diagram illustrating an example of an operation in which a matrix is formed with the structure shown in FIG. 1.

As shown in an example of a voltage to be applied to each line in the case in which the display is to be carried out on a certain pixel P (write is carried out in the data holding section) with this structure, for instance, in the case in which the pixel P selected from pixels formed in a matrix shown in FIG. 9 is to be carried out, a so-called ⅓ $V_{cc}$ method is executed. For example, a write voltage of ⅓ $V_{cc}$ is applied to the control line 7 of the pixel thus selected and a voltage of −⅓ $V_{cc}$ is applied to the other control line 7, and a voltage of −⅔ $V_{cc}$ is applied to the write line 8 of the pixel selected and 0 is applied to the other write line 8. The write is carried out by applying an electric potential of $V_{cc}$. When the electric potential of $V_{cc}$ is applied to the control line to which the pixel P belongs and 0 is applied to the write line, an electric potential of $V_{cc}$ for writing prevention should be applied to a write line to which the pixel does not belong. Since the influence on other pixels cannot be prevented, this method cannot be used. When electric potentials of ½ $V_{cc}$ and −½ $V_{cc}$ are applied, an electric potential of |½ $V_{cc}$| is always applied to a non-selected pixel. Consequently, the method is not preferable to minimize a voltage applied to the non-selected pixel.

This method has the following difficulty. More specifically, a voltage of |⅓ $V_{cc}$| is always applied to the non-selected pixel, a channel region of each cell should be isolated by a well and each cell should be separated from each other or should be isolated by an insulator so that the cell is made large-sized, and gradation display is carried out with difficulty by only the ON/OFF control. However, in spite of such a difficulty, it is possible to constitute a much more excellent nonvolatile display device by an EEPROM or a flash memory.

In the case in which a dynamic image is to be displayed for a long time, therefore, there are serious problems, that is, writing and erasing operations should be carried out at a high voltage of 12 V in the EEPROM and the flash memory and a booster circuit is required and power consumption is large, the writing operation should be carried out after the erasing operation is executed once so that the writing operation takes several milliseconds to several seconds, the writing operation is carried out $10^5$ times and a lifetime is too short when a dynamic image is to be rewritten 60 times per second. By using the ferroelectric capacitor, however, the writing operation can be carried out at a speed of 10 nanoseconds or less at a voltage of 3 V or less. In addition, the number of rewriting operations is $10^{12}$ times or more and the lifetime can be thereby prolonged.

Figure 2:
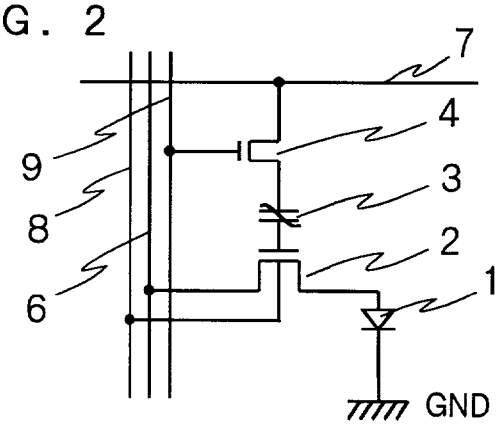
FIG. 2 is a diagram illustrating a variant in which a selective transistor is provided on the structure of FIG. 1.

The structure shown in FIG. 2 is an example to eliminated the drawback that the writing operation carries out the gradation display with difficulty by only the ⅓ $V_{cc}$ method and the ON/OFF control. More specifically, the source and the drain of the selective transistor 4 are connected between the ferroelectric capacitor 3 and the control line 7, and the gate of the selective transistor 4 of each pixel arranged in the column direction is connected to a selective line 9. In other words, the selective line 9 is connected in parallel with the write line 8. As a result, a pixel to which display data are applied can be selected by the control line 7 and the selective line 9, and a voltage to be a desirable threshold voltage is applied between the control line 7 to which the selected pixel belongs and the write line 8. Consequently, a driving current flowing to the display element 1 can be controlled to have a desirable value.

More specifically, only one pixel is selected by the selective transistor 4. Therefore, other pixels are not influenced but an electric potential to be applied to the control line 7 can be set optionally. In this case, when the ferroelectric capacitor 3 is polarized at a low voltage, is polarized to an intermediate voltage to be maintained. Before that, it is necessary to apply a voltage (a negative voltage) in a reverse direction, thereby erasing a polarization written at a high voltage. With such a structure, the display data can be applied without using the ⅓ $V_{cc}$ method, and the gradation display as well as the ON/OFF control can be carried out.

Figure 3:
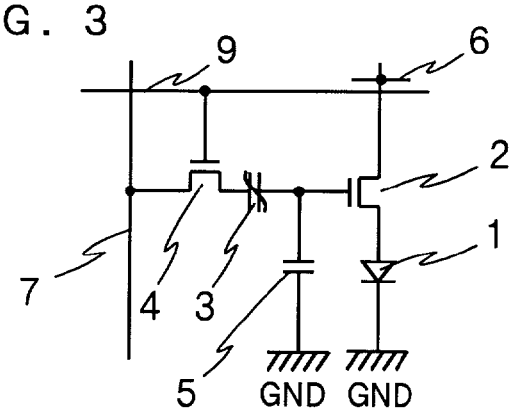
FIG. 3 is a diagram illustrating a variant in which a capacitor is provided on the structure of FIG. 2.
Figure 4:
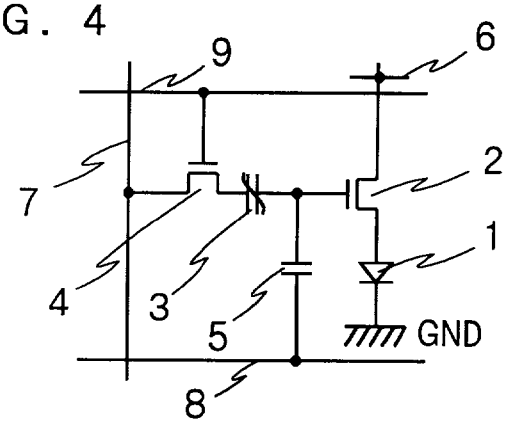
FIG. 4 is a diagram illustrating a variant in which a capacitor is provided on the structure of FIG. 2.

With the structures shown in FIGS. 3 and 4, the back gate control can be eliminated and a cell can be highly integrated to cause the whole display device to be very small-sized. More specifically, the capacitor 5 is connected between a connecting portion of the MOS transistor 2 and the ferroelectric capacitor 3 which are control elements and the ground GND(the structure shown in FIG. 3) or the write line 8 (the structure shown in FIG. 4) and a voltage is applied between the control line 7 and the ground GND or write line 8 so that display data are applied to the MOS transistor 2 to be the control element and the display data are written to the ferroelectric capacitor 3 to be the data holding section. With the structure shown in FIG. 3, the write line is not required but a reverse potential is required when the ON/OFF is to be reversed. Therefore, a booster circuit for obtaining a double electric potential is required. On the other hand, with the structure shown in FIG. 4, it is preferable that an electric potential to be applied should be reversed between the control line 7 and the write line 8. Consequently, there is an advantage that the booster circuit is not required.

The connection to the write line 8 through the capacitor 5 is carried out for the following reason. More specifically, when the connecting portion of the ferroelectric capacitor 3 and the MOS transistor 2 is directly connected to the write line 8, both electrodes of the ferroelectric capacitor 3 are set in such a state that electric charges can be moved because the other end side of the ferroelectric capacitor 3 is also connected to the control line 7 through the selective transistor 4 (through no insulating layer). In such a state that the electric charges can be moved, even the polarization of the ferroelectric substance is annihilated so that the data cannot be held. In other words, one of the electrodes of the ferroelectric capacitor 3 should be set in such a floating state as to be electrically insulated by the gate insulating film of the MOS transistor 2, the capacitor 5 or the like as shown in FIGS. 3 and 4.

With these structures, it is not necessary to carry out the back gate control. Therefore, it is not necessary to make the back gate independent by each pixel so that a space between cells can be reduced and high integration can be obtained. In addition, the applied voltage can be divided efficiently and can be applied to the ferroelectric capacitor 3. More specifically, with the structures shown in FIGS. 1 and 2, it is hard to fabricate a high characteristic element having the MFS structure in respect of a semiconductor manufacturing process. Therefore, the MFIS structure is used practically. With the MFIS structure, however, the ferroelectric capacitor and a capacitor to be an insulating film having a small dielectric constant are connected in series and a voltage is applied to both ends thereof. The voltage applied to the both ends is divided and applied to the ferroelectric capacitor and the capacitor having a low dielectric constant. A division ratio of the voltage is inversely proportional to respective capacities. Therefore, only a low voltage is applied to a ferroelectric capacitor having a high dielectric constant and a great capacity. Therefore, a high voltage is required to obtain a desirable division characteristic.

On the other hand, with such a structure that a voltage can be applied through the capacitor 5 separate from the insulating film of the MFIS structure as shown in FIGS. 3 and 4, the capacity of the capacitor 5 can be increased by using an insulating film having a high dielectric constant or increasing an area because the capacitor 5 is not related to the transistor. Thus, the division ratio into the ferroelectric capacitor 3 can be increased.

Figure 10:
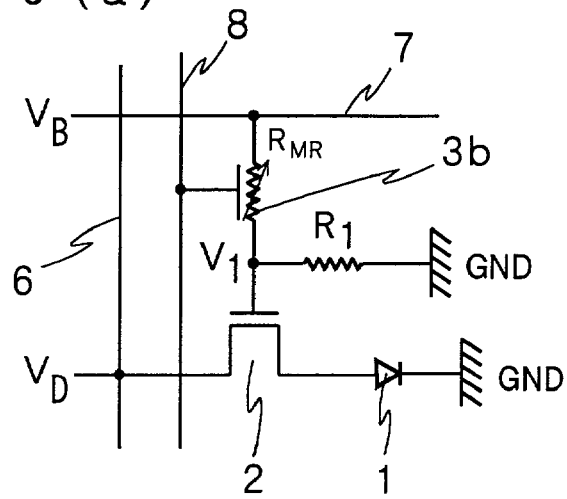
FIGS. 10(*a*) to 10(*c*) are diagrams illustrating a structure in which an MR element is used as a nonvolatile data holding section.
Figure 10:
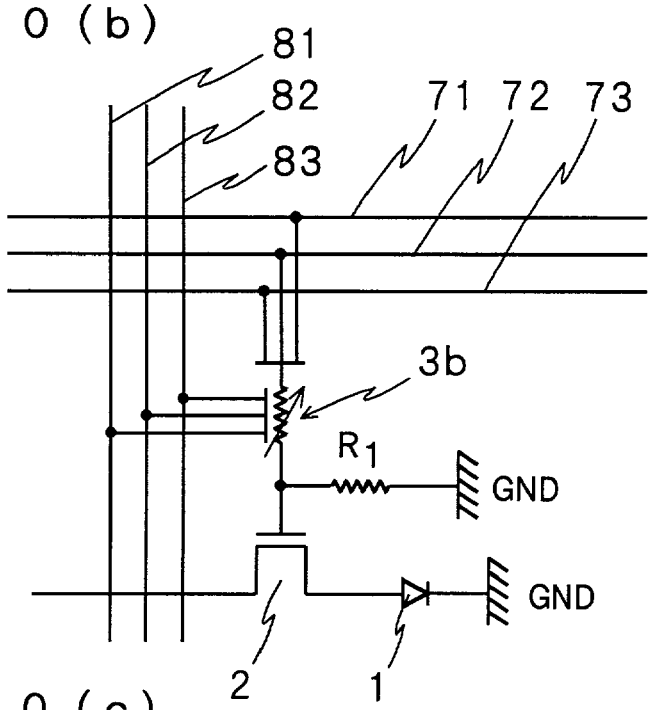
Figure 10:
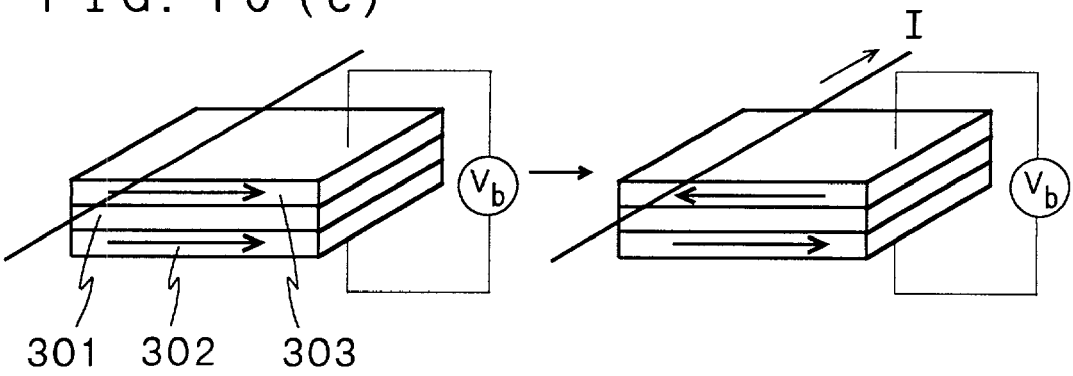

FIGS. 10(*a*) to 10(*c*) show an example in which a magnetoresistive element (MR element) 3*b* is used as a non-volatile data holding section. More specifically, an MRMA (magnetoresistive memory) connected to a control line 7 through the MR element 3*b* and a display element 1 are connected to the gate side of a MOS transistor 2 to be a control element, thereby constituting one pixel. A connecting portion of the MR element 3*b* and the gate of the MOS transistor 2 is connected to a ground GND through a resistor $R_1$.

The MR element 3*b* has ferromagnetic layers 302 and 303 provided on both sides through a non-magnetic layer 301 as shown in FIG. 10(*c*). By causing a current to flow, the direction of magnetization is inverted. In the case in which the directions of magnetization of both ferromagnetic layers 302 and 303 are parallel (the same direction) and non-parallel (the reverse direction) (the resistance is higher in the non-parallel direction), 0 and 1 (ON and OFF) can be stored depending on a difference between the resistances. A writing current is caused to flow between the control line 7 and the write line 8 shown in FIG. 10(*a*). The ON/OFF control is carried out depending on a current flowing between the control line 7 and the ground GND. The MOS transistor 2 is controlled so that the application of the electric potential of the control line to the display element 1 is controlled with a voltage $V_1$ divided by the MR element 3*b* and the resistor $R_1$.

More specifically, a voltage $V_B$ of the control line 7 is divided into the resistor $R_{MR}$ of the MR element 3*b* and the resistor $R_1$. Consequently, $V_1=V_B \cdot R_1/(R_{MR}+R_1)$ is obtained. If the MR element 3*b* has a low resistance $R_{MR(ON)}$, $V_1=V_B \cdot R_1/(R_{MR(ON)}+R_1)$ is obtained. If the MR element 3*b* has a high resistance $R_{MR(OFF)}$, $V_1=V_B \cdot R_1/(R_{MR(OFF)}+R_1)$ is obtained. Accordingly, the voltage $V_B$ of the control line 7 is set such that the transistor 2 is turned ON or OFF with this voltage. Consequently, at the time of standby in which the display state is not changed, the voltage is maintained to be applied so that the same display can be continuously obtained. Moreover, when writing to change the display state is to be carried out, the control line other than the control line of a pixel to be selected is set to the ground GND and a writing voltage is applied between the control line 7 of the pixel to be selected and the write line 8. Consequently, the resistance of the MR element 3*b* is changed.

With this structure, the electric potential $V_B$ should be continuously applied to the control line 7 while the display device is operated differently from the case in which the ferroelectric substance is used. However, the resistance of the MR element 3*b* can be greatly increased by using an insulating layer for an intermediate layer 301 of the MR element 3*b*, and can be set to be $10^9$ Ω or more which is almost equal to that of the organic EL element 1. Consequently, an electric potential $V_D$ for driving the organic EL element 1 can also be applied exactly and power consumption is less increased and a driving method can be carried out easily. On the other hand, it is not necessary to apply the whole display data of an image again at each time and new data can be applied to only a changed image. Therefore, also in the case in which a dynamic image to be changed at a rate of approximately 60 frames per second is to be transmitted through internet, the data can be greatly compressed so that a data processing can be carried out very easily.

In the above-mentioned example, the ON/OFF of the MR element 3*b* has been described. In the case in which gradation display having a brightness changed is to be carried out, plural sets of control lines 71, 72 and 73 and write lines 81, 82 and 83 are provided as shown in FIG. 10(*b*), for example. Thus, the degree of magnetization is varied with a different current so that a resistance value can be varied and a control voltage of the MOS transistor 2 can be changed. Consequently, the gradation display can be obtained.

By using the MR element as the nonvolatile data holding section, thus, the size can be reduced to be almost equal to that of a DRAM. In addition, the rewriting operation can be carried out in a short time almost infinite times. The display data of each pixel are continuously held. Therefore, also in the case in which the display data of a dynamic image are to be transferred, the data volume is reduced and it is not necessary to carry out a work for creating and reconstituting compression data. Thus, a signal processing can be executed very readily.

Figure 11:
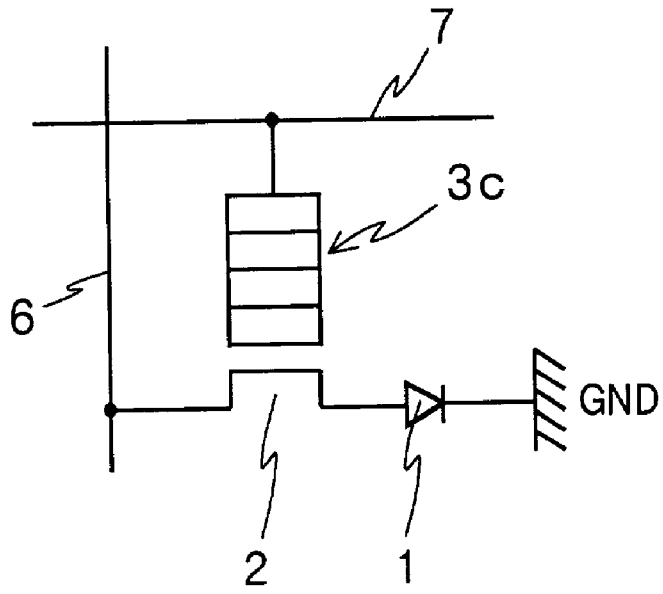
FIGS. 11(*a*) and 11(*b*) are diagrams illustrating a structure in which a single electronic memory is used as the nonvolatile data holding section.
Figure 11:
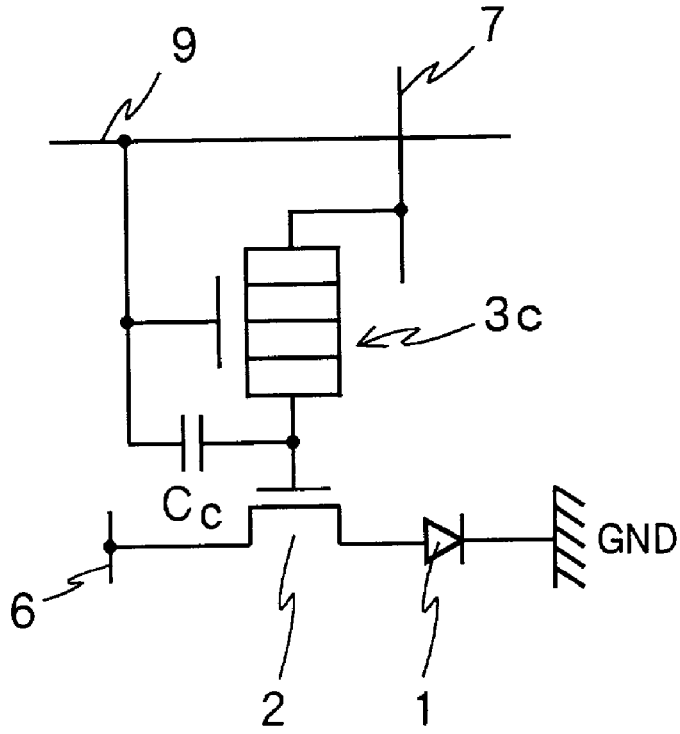
Figure 12:
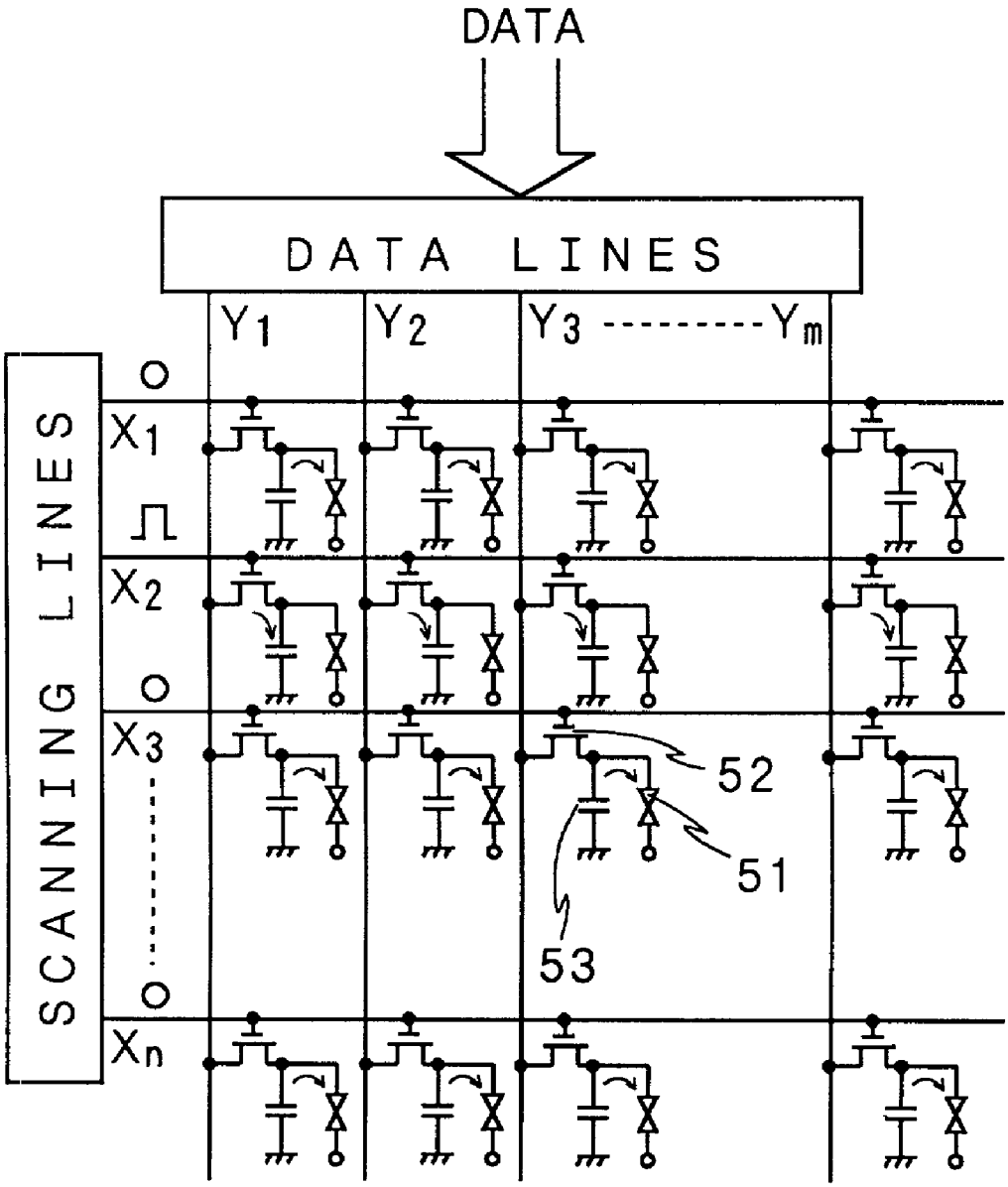
FIG. 12 PRIOR ART
FIG. 12 is a diagram illustrating an example of a structure in which a display device is constituted by a conventional liquid crystal panel.

FIGS. 11(*a*) and 11(*b*) show an example in which the nonvolatile data holding section is constituted by a single electronic memory 3*c*. More specifically, FIG. 11(*a*) shows an example of a horizontal type structure in which a multilayered tunnel junction (MTJ) is formed on the gate side of the MOS transistor 2 and electrons are tunneled as in a memory, thereby carrying out writing. Also in such a structure, an electric potential can be held in the single electron memory 3*c* by applying a voltage between the control line 7 and the driving line 6, and the display state can be held in a floating state. As a result, the display data of each pixel can be held in the same manner as that described above. It is preferable that new display data should be applied to only the pixel to be changed in the display state.

FIG. 11(*b*) shows an example in which the same structure is constituted by a vertical type MOSFET. With this structure, the vertical type MOSFET is provided separately from the MOS transistor 2 to be the control element and a tunnel layer is provided, and a gate is connected to the write line 9 and a drain is connected to the control line 7. $C_c$ denotes an intrinsic capacitor (built-in coupling capacitor). In an operation, display data can be held in the same manner as in the horizontal type MOSFET in FIG. 11(*a*).

With such a structure, the number of writing operations can be increased considerably and electrons can be floated in the same manner as in a flash memory. The same display can be continuously maintained even if data for display are not applied consecutively. Consequently, power consumption can be reduced, a data volume can be decreased considerably and data can be transferred easily in the same manner as compression data.

In each of the above-mentioned examples, the organic EL element has been used-as the display element 1. Also in the LED to be the display element, the current driving operation can be carried out with the same circuit structure. On the other hand, if a liquid crystal device is used as the display element, a brightness of a liquid crystal cannot be changed with the control voltage of the MOS transistor 2 due to voltage driving. Consequently, binary display of ON/OFF is obtained. However, an image can be displayed while holding the display data with the same circuit structure as that shown in FIGS. 1 to 4.

According to the present invention, the display element is combined with the nonvolatile memory. Therefore, it is not necessary to rewrite the display data of whole pixels at any time and it is sufficient that new display data are applied to only a pixel to be changed in a display state. Consequently, if a ferroelectric substance is used as the nonvolatile memory, rewriting power can be reduced considerably so that power consumption can be lessened remarkably. Even a microdisplay can be operated for a long period with a very small battery. As a result, the spread of an HMD (Head Mounted Display) or the like can be achieved, and application to a wellable computer, a finder, a handy phone and the like can be promoted.

Furthermore, the display data of each pixel can be held continuously. Therefore, also in the case in which the display data such as a dynamic image are to be processed, it is sufficient that only the data of a pixel to be changed are processed. Thus, a data processing can be lessened considerably. Also in the case in which data transfer is to be carried out through internet communication, a processing can be carried out easily with a very small data volume.

By using this method for the liquid crystal display, furthermore, display data do not need to be changed because a pixel which is not changed has a display state of nonvolatile held data. Therefore, a jitter is not caused. In the case in which this method is used for a projector or the like, an eye-friendly display state can be obtained.

Numerous modifications and alternative embodiments of the present invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A display device, comprising:

a display element;

an MFMIS structure transistor which has a first metal layer, a ferroelectric layer, a second metal layer for gate electrode and an insulator layer provided on a semiconductor layer, a source and drain of said MFMIS structure transistor being connected to said display element and a driving line and said first metal layer being connected to a control line; and a capacitor connected between said second metal layer and a ground or a write line, wherein the control data is written to said MFMIS structure transistor by using said control line and said ground or said write line, and wherein the MFMIS structure transistor maintains a floating state while the control data is written thereto.

2. The display device of claim 1, wherein a selective transistor is connected between a nonvolatile data holding section and said control line, and a gate of said selective transistor is connected to a selective line.

3. The display device of claim 1, wherein said display element is formed by an organic EL element.

4. A display device, comprising:

a display element;

a MOS transistor, a source and drain of said MOS transistor being connected to said display element and a driving line;

a ferroelectric capacitor connected between a gate of said MOS transistor and a control line; and a capacitor connected between said gate and a ground or a write line, wherein the control data is written to said ferroelectric capacitor by using said control line and said ground or said write line, and wherein said ferroelectric capacitor maintains a floating state while the control data is written thereto.

5. The display device of claim 4, wherein a selective transistor is connected between said ferroelectric capacitor and said control line, and a gate of said selective transistor is connected to a selective line.

6. The display device of claim 4, wherein said display element is formed by an organic EL element.

7. A display device, comprising:

a display element;

a control element for controlling a voltage or a current to be applied to said display element to drive said display element; and a nonvolatile data holding section integrated with said control element or connected to said control element and capable of holding control data of said control element in a floating state;

wherein said nonvolatile data holding section is constituted by an element utilizing a magnetoresistance effect or a single electron memory having electrons stored in quatum dot over a barrier region.

8. The display device of claim 7, wherein said display element is formed by an organic EL element.

* * * * *